United States Patent [19]

Knabe et al.

[11] Patent Number: 4,461,329

[45] Date of Patent: Jul. 24, 1984

[54] ARRANGEMENT FOR CENTERING CONTAINERS IN BOTTLE TREATMENT MACHINES

[75] Inventors: Uwe Knabe, Holzwickede; Dieter Unger, Waltrop, both of Fed. Rep. of Germany

[73] Assignee: Holstein und Kappert GmbH, Dortmund, Fed. Rep. of Germany

[21] Appl. No.: 342,166

[22] Filed: Jan. 25, 1982

[30] Foreign Application Priority Data

Jan. 29, 1981 [DE] Fed. Rep. of Germany ..... 3102920

[51] Int. Cl.[3] ..... B65B 3/04

[52] U.S. Cl. ..... 141/150; 141/165; 141/172; 141/191; 141/312; 141/371

[58] Field of Search ..... 141/129-191, 141/250-284, 312, 371, 1-12

[56] References Cited

FOREIGN PATENT DOCUMENTS 1170815 5/1964 Fed. Rep. of Germany ..... 141/165

*Primary Examiner*—Houston S. Bell, Jr.

*Attorney, Agent, or Firm*—Michael J. Striker

[57] ABSTRACT

An arrangement for centering containers in a bottle treatment machine, particularly in a bottle filling machine, has centering elements arranged to be located below filling valves and movable in vertical direction, bottle lifting organs having a receiving plane and movable below the centering elements in the vertical direction, and a curved guiding element arranged to guide the bottle lifting organs so as to lower the latter in an outlet region and thereafter, after taking over a bottle and passing an inlet region, to raise them again, wherein the guiding element is formed so that the receiving plane of the lifting organs prior to a contact point between a filling path and an inlet star path, as considered in a supply direction of the bottles, coincides with a bottle supply plane of the inlet star, and during further rotation in direction toward the contact point the receiving plane of the lifting organs is located higher than the bottle supply plane of the inlet star.

6 Claims, 3 Drawing Figures

ARRANGEMENT FOR CENTERING CONTAINERS IN BOTTLE TREATMENT MACHINES

BACKGROUND OF THE INVENTION

The present invention relates to an arrangement for centering containers in bottle treatment machines, particularly for filling of bottles in filling machines.

Arrangements of this general type are known in the art. In the bottle-filling machines the bottles are engaged by an inlet star and moved into the region of rotation of filling valves. A known centering arrangement includes centering tulips arranged below the filling valves and movable in a vertical direction, and bottle-lifting organs which are guided in the region of the inlet and outlet stars along a curved guide located below the bottle movement plane, so that in an outlet region they are lowered and after taking over a bottle and passing the inlet star region they are again lifted. In the known filling machines, the planes of the supporting plates and of the bottle supply path of the inlet star associated with the filling machine path are located at the same height. The centering tulips arranged above the lifting organs or their supporting plates serve for the purposes of unobjectionably centering the bottles during the lifting under the filling valves and are located above the bottle mouths. This position is required in order to make possible a disturbance-free introduction of the bottles into the filling machine rotary path. This, however, is connected with the disadvantage that the bottles in the region of the contact point, that is in the region of the direct taking over, are not centered during a short time. This can lead to disturbances, particularly in high-output machines.

In view of these considerations, it has been proposed to lower the centering tulips relative to the incoming bottles by special curved paths which are provided on a stationary housing of the filling machine. These known features are, however, connected with considerable expense.

SUMMARY OF THE INVENTION

Accordingly, it is an object of the present invention to provide a centering arrangement for bottle treatment machines, which avoids the disadvantages of the prior art.

More particularly, it is an object of the present invention to provide a centering arrangement for a bottle treatment machine, which eliminates the above mentioned disadvantages in such a manner that a mouth region of the bottles during the withdrawal from guiding pockets of a supply star is guided into an associated centering tulip, whereby lowering of the centering tulip relative to the supplied bottle can be dispensed with. Thereby the bottles are automatically lifted prior to taking over and moved relative to the centering tulips, and during further upward movement are automatically transported until abutment against a filling organ.

The above mentioned objects of the present invention are attained with the aid of a curved guiding member whose functions are to lower the lifting organs after termination of the filling process so that their supporting plates on which the bottles rest are lowered to a carrying plane of an outlet star, then retained at this height, and after taking over a bottle behind the inlet star are again lifted.

In keeping with these objects, and with others which will become apparent hereinafter, one feature of the present invention resides, briefly stated, in an arrangement for centering containers in a bottle treatment machine, in which the curved guiding element is formed so that a receiving plane of the lifting organs (or the supporting plate) in a supplying direction of the bottles, prior to a contact point of a filling path and an inlet star path, coincides with a supply plane of the inlet star, and during further rotation in direction toward the contact point said receiving plane is lifted so that in the contact point the receiving plane (or supporting plate) of the lifting organs is higher than the bottle supply plane of the inlet star.

When the centering arrangement is designed in accordance with the present invention, an additional lowering movement of the centering tulips relative to the bottles is not necessary, so that a considerable structural simplification takes place since the guiding elements for the lifting organs are available in this region. The inventive construction departs from the approach that the contact point both the bottle movement plane and also the receiving plane of the supporting plates must be arranged at the same height. In accordance with the invention, the supporting plates and bottles in the movement direction, prior to the contact point, are located at the same height. This region extends over the curved guiding element so wide that during the taking over or transfer process the bottles are taken over from the supporting plate for the greater part and are sufficiently moved in the guiding pockets of the associated inlet star. The inlet star retains this guidance to the contact point. In this region the bottle contact with the associated centering tulip so that a jointless centering of the bottles rotating with high speed is guaranteed.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
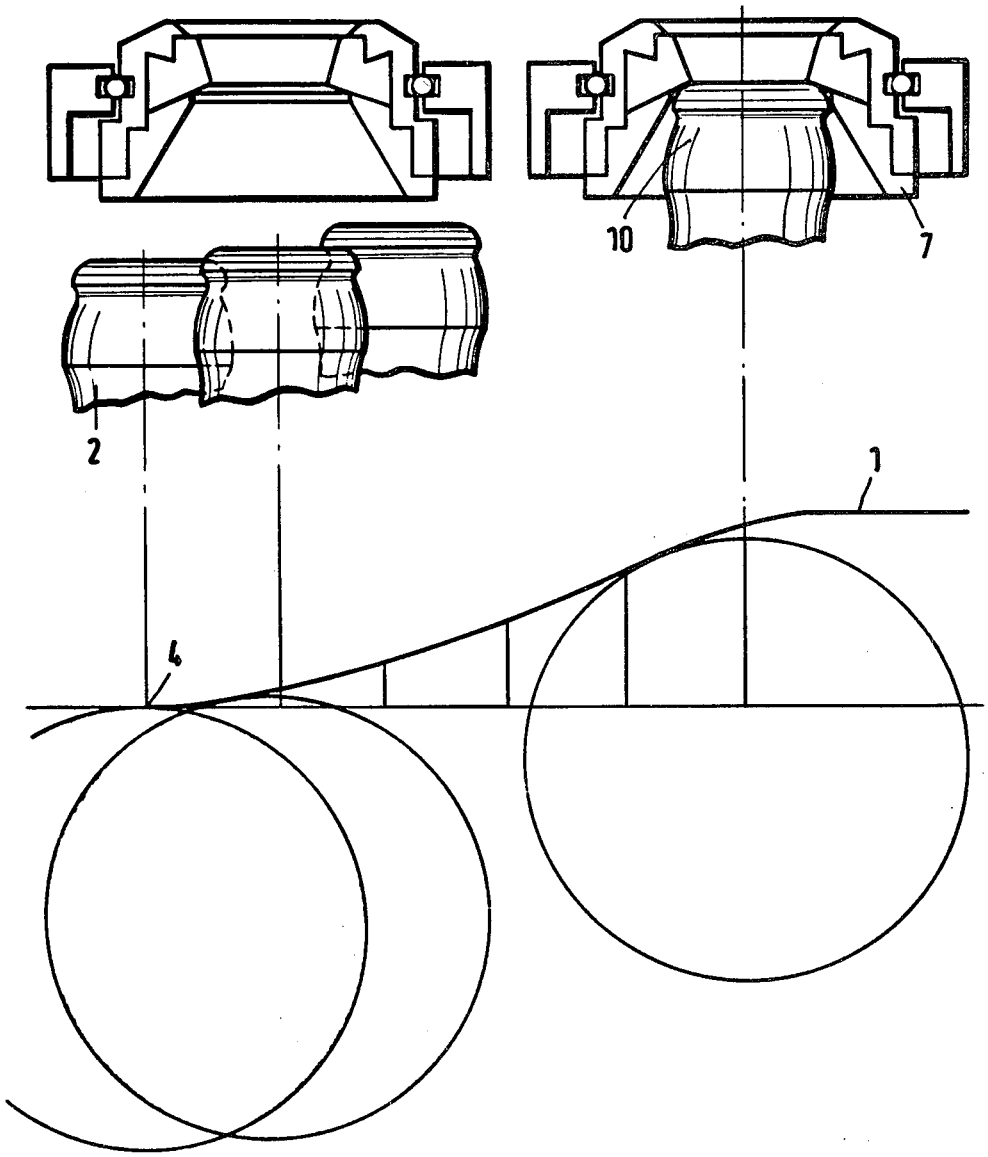
FIG. 1 is a lateral view of a curved guiding element with centering tulips arranged thereabove, of a centering arrangement in accordance with the present invention.
Figure 2:
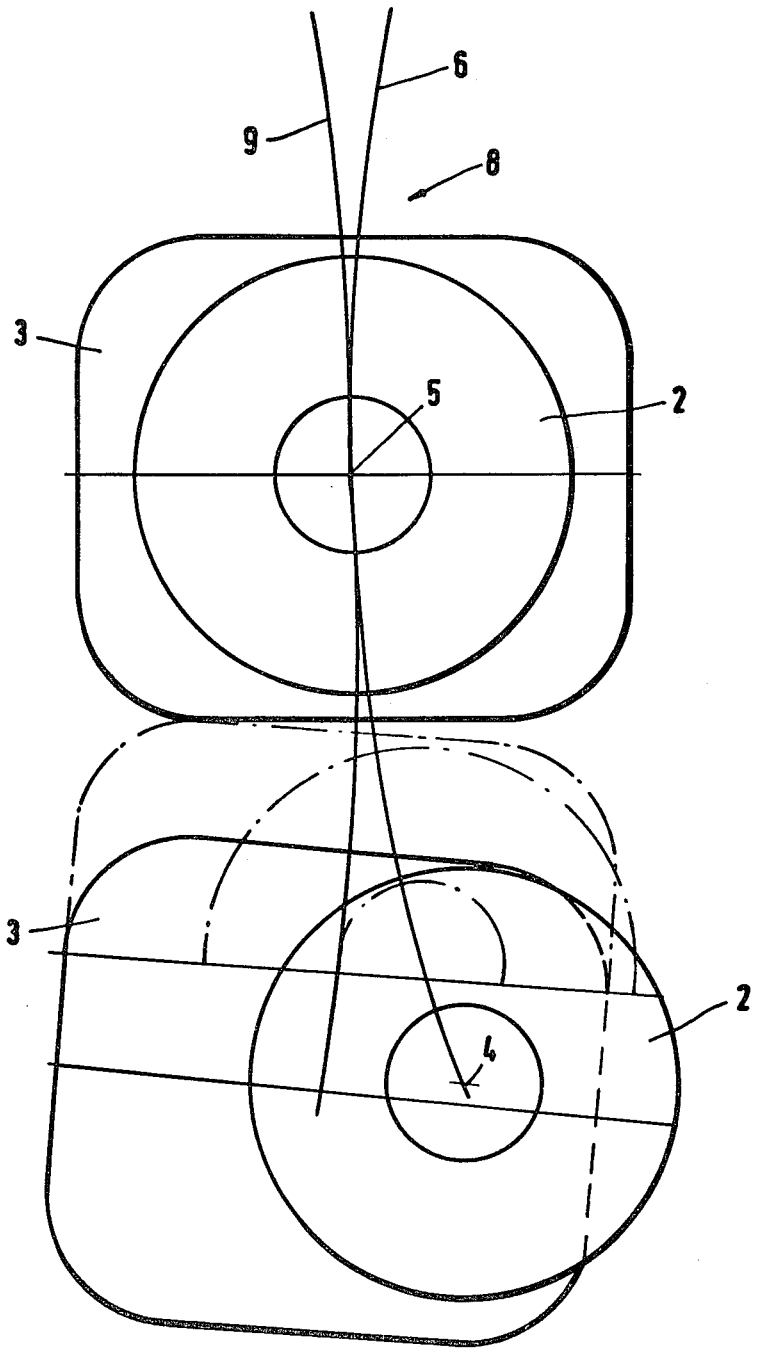
FIG. 2 is a view showing a bottle movement path to the region of a contact point.
Figure 3:
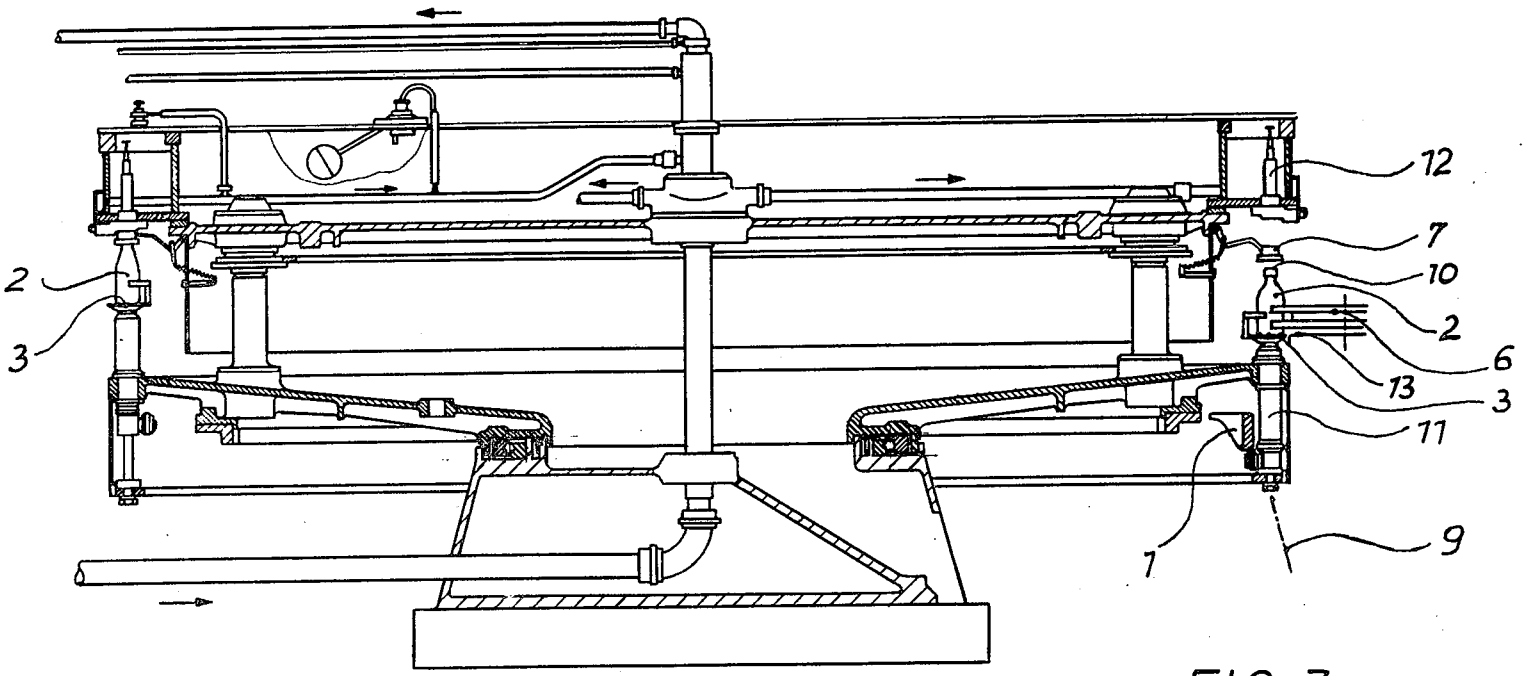
FIG. 3 is a view showing a part of a bottle treatment machine.

An arrangement for centering containers in a bottle treatment machine, such as in a bottle filling machine, has a curved guiding element with a guiding curve identified by reference numeral 1. The guiding element lowers lifting organs directly before an outlet star and after receipt of a bottle 2 by a supporting plate 3 again raises the lifting organs.

As can be seen from the drawing, the curve 1 is formed so that in a point 4 which is located prior to a contact point 5 as considered in a bottle movement direction, the supporting plate 3 is already located in the same plane in which a bottle supply plane 13 of an inlet star 6 is located, or in other words in the same plane in which it is preset by the bottle supply plane 13 inside the inlet star 6.

In this region the bottles identified by reference numeral 2 are sufficiently supported by the supporting plate 3, so that during their further movement in the guiding pockets of the inlet star 6 they are retained from outside by a curved path leading to the contact point. During further approaching of a partial inlet star path 8 to a partial path of the filling machine until the contact point 5, a continuously increasing lifting of the bottles takes place, whereby they are lifted along the conically formed centering openings of the tulips up to their center.

As soon as the contact point 5 is reached, the bottles are located with their mouth region 10 unobjectionably centered under the associated centering tulips 7. The latter, during further rotation of the filling machine along rotary path 9, are lifted by the lifting organs 11 to be located under the filling elements 12.

By the offset of the actual taking over plane prior to the actual contact point 5, the bottles without manipulation of the associated centering tulips 7 can be unobjectionably inserted into the latter. Removal of the bottles is also carried out similarly to the above described supply of the bottles into the filling machine. This is attained in such a manner that the guiding curve is formed symmetrically in its inlet and outlet region, and the curve is associated with the locations of the stars.

It will be understood that each of the elements described above, or two or more together, may also find a useful application in other types of constructions differing from the types described above.

While the invention has been illustrated and described as embodied in an arrangement for centering containers in a bottle treatment machine, it is not limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a bottle treatment machine, particularly in a bottle-filling machine having filling valves rotatable along a predetermined filling path, an inlet star engaging the bottles and movable in a bottle supply plane along an inlet star path which contacts said filling path in a contact point and so as to move the bottles in a bottle movement plane, and an outlet star, the improvement comprising: an arrangement for centering containers including centering elements arranged to be located below the filling valves and movable in a vertical direction; bottle lifting organs having a receiving plane and movable below said centering elements in the vertical direction; and a curved guiding element arranged to guide said bottle lifting organs in its movement along said guiding element in the region of said inlet and outlet stars below the bottle movement plane so that said bottle lifting organs are lowered in an outlet region and thereafter after taking over a bottle and passing an inlet region are again raised, said guiding element being formed so that said receiving plane of said lifting organs prior to said contact point of said filling path and said inlet star path as considered in a supplying direction of the bottles coincides with said bottle supply plane of said inlet star, and during further rotation in direction toward said contact point said receiving plane of said lifting organs is located higher than said bottle supply plane of said inlet star so that it is not necessary to lower said centering elements.

2. An arrangement as defined in claim 1, wherein said lifting organs have supporting plates forming said receiving plane.

3. An arrangement as defined in claim 1, wherein said curved guiding element is provided with a guide curve arranged to guide said lifting organs.

4. An arrangement as defined in claim 1, wherein said centering elements are formed as centering tulip-shaped members.

5. An arrangement as defined in claim 1, wherein said centering elements have a centering plane and are held unchangeable in their movement plane, said guiding element being arranged so that in said contact point of said filling path and said inlet star path the bottles are brought to abutment against said centering elements.

6. An arrangement as defined in claim 1, wherein said guiding element has inlet and outlet regions which are symmetrical relative to one another.

* * * * *